US005382185A

United States Patent [19]

Gray et al.

[11] Patent Number: 5,382,185

[45] Date of Patent: Jan. 17, 1995

[54] THIN-FILM EDGE FIELD EMITTER DEVICE AND METHOD OF MANUFACTURE THEREFOR

[75] Inventors: Henry F. Gray; David S. Y. Hsu, both of Alexandria, Va.

[73] Assignee: The United States of America as represented by the Secretary of the Navy, Washington, D.C.

[21] Appl. No.: 40,944

[22] Filed: Mar. 31, 1993

[51] Int. Cl.[6] ..... H01J 1/30

[52] U.S. Cl. ..... 445/49; 313/309; 313/336; 437/228

[58] Field of Search ..... 313/309, 336; 445/49, 445/50, 24; 437/228

[56] References Cited

U.S. PATENT DOCUMENTS

| | | | |
|---|---|---|---|
| 4,168,213 | 9/1979 | Hoeberechts | 445/24 |
| 4,307,507 | 12/1981 | Gray et al. | 313/309 X |
| 4,685,996 | 8/1987 | Busta et al. | 156/657 |
| 4,916,002 | 4/1990 | Carver | 156/657 |
| 4,943,343 | 7/1990 | Bardai et al. | 445/50 X |
| 5,007,873 | 4/1991 | Goronkin et al. | 445/49 |
| 5,026,437 | 6/1991 | Neukermans et al. | 156/657 |
| 5,057,047 | 10/1991 | Greene et al. | 445/24 |
| 5,090,932 | 2/1992 | Dieumegard et al. | 445/24 |
| 5,110,760 | 5/1992 | Hsu | 437/201 X |
| 5,126,287 | 6/1992 | Jones | 445/50 |
| 5,136,764 | 8/1992 | Vasquez | 437/228 |
| 5,186,670 | 2/1993 | Doan et al. | 445/24 |
| 5,199,917 | 4/1993 | MacDonald et al. | 313/336 X |
| 5,214,347 | 5/1993 | Gray | 313/355 |

OTHER PUBLICATIONS

Spindt et al., "Physical properties of thin-film field emission cathodes with molybdenum cones," Journal of Applied Physics, vol. 47, No. 12, pp. 5248-5263 (1976).

Hsu et al, "20 NM Linewidth Platinum Pattern Fabrication Using Conformal Effusive-Source Molecular Precursor Deposition and Sidewall Lithography" J. Vac. Sci. Technol. B10(5), Sep./Oct. 1992, pp. 2251-2258.

*Primary Examiner*—Kenneth J. Ramsey

*Attorney, Agent, or Firm*—Thomas E. McDonnell; Daniel Kalish

[57] ABSTRACT

Thin-film edge field emitter devices are provided which are capable of low voltage operation. The method of manufacture of the devices takes advantage of chemical beam deposition and other thin-film fabrication techniques. Both gated and ungated devices are provided and all of the devices include a plurality of thin-films deposited on the side-wall of a non-flat substrate. The gated emitter devices include alternating conductive and electrically insulating layers, and upper parts of the latter are removed to expose the upper edges of the conductive layers, with a central one of these conductive layers comprising an emitter for emitting electrons. The emitter devices can be inexpensively produced with a high degree of precision and reproducibility without the need for expensive lithographic machines. The devices can be used in field emitter arrays employed as vacuum transistors, vacuum microelectronic analog and digital devices, and modulated or cold electron sources.

27 Claims, 6 Drawing Sheets

THIN-FILM EDGE FIELD EMITTER DEVICE AND METHOD OF MANUFACTURE THEREFOR

CROSS-REFERENCE TO RELATED APPLICATIONS

This application is related to commonly assigned U.S. Pat. No. 5,214,347, issued on May 25, 1993 to Henry F. Gray and entitled "Layered Thin-Edged Field-Emitter Device."

FIELD OF THE INVENTION

The present invention relates to ungated and gated thin-film edge field emitters capable of emitting electrons of relatively low voltage and to methods for making the same.

DESCRIPTION OF THE RELATED ART

Very small localized vacuum electron sources which emit sufficiently high currents for practical applications are difficult to fabricate. This is particularly true when the sources are required to operate at reasonably low voltages. Presently available thermionic sources do not emit high current densities, but rather result in small currents being generated from small areas. In addition, thermionic sources must be heated, requiring special heating circuits and power supplies. Photo emitters have similar problems with regard to low currents and current densities.

Field emitter arrays (FEAs) are naturally small structures which provide reasonably high current densities at low voltages. FEAs typically comprise an array of conical, pyramidal or cusp-shaped point, edge or wedge-shaped vertical structures which are electrically insulated from a positively charged extraction gate and which produce an electron beam that travels through an associated opening in the charged gate.

The classical field emitter includes a sharp point at the tip of the vertical structure and opposite an extraction electrode. In order to generate electrons which are not collected at the extraction electrode, but can be manipulated and collected somewhere else, a hole is created in the extraction electrode which hole is significantly larger (e.g. two orders of magnitude) than the radius of curvature of the field emitter. Thus, the extraction electrode is a flat horizontal surface containing an extraction electrode hole for the field emitter. The field emitter is centered horizontally in the extraction electrode hole and does not touch the extraction electrode, although the vertical direction of the field emitter is perpendicular to the horizontal plane of the extraction electrode. The positive charges on the edge of the extraction electrode hole surround the field emitter symmetrically so that the electric field produced between the field emitter and the extraction electrode causes the electrons to be collected on an electrode (anode) separate and distinct from the extraction electrode. A very small percentage of the electrons are intercepted by the extraction electrode. The smaller the aperture, i.e., the closer the extraction electrode is to the field emitter, the lower the voltage required to generate the electron beam.

It is difficult to create FEAs which have reproducibly small radius-of-curvature field emitter tips of conducting materials. Furthermore, it is equally difficult to gate or grid these structures where the gate-to-emitter distance is reasonably small to provide the necessary high electrostatic field at the field emitter tip with reasonably small voltages. The radius of curvature is typically 100–300 angstroms (Å) and the gate-to-emitter distance is typically 0.1–0.5 micrometers ($\mu$m).

Current methods of manufacturing FEAs include wet etching, reactive ion etching, and a variety of field emitter tip deposition techniques. Practical methods generally require the use of lithography which has a number of inherent disadvantages including the high cost of the equipment needed. Furthermore, the high degree of spatial registration required prevents parallel processing, i.e., the fabrication of a very large number of emitters at the same time in a single process.

SUMMARY OF THE INVENTION

It is therefore an object of the present invention to provide a field emitter device which substantially eliminates the need for the use of high spatial resolution lithography in its fabrication.

It is another object of the present invention to provide a field emitter device having inherent advantages over previous electron sources, including higher emission currents, lower power requirements, less expensive fabrication costs and ease of integration with other circuitry.

It is a further object of the present invention to fabricate gated and ungated thin-film edge field emitter devices wherein the spacing between the elements is small enough to enable low voltage operation.

It is a further object of the present invention to fabricate FEAs over a large area in a manner which is inexpensive, yet results in an equal or greater degree of precision and reproducibility when compared with other prior art processes.

According to a first aspect of the invention, an ungated thin-film edge field emitter is provided which comprises a substrate including an essentially horizontal portion and a non-flat (raised) portion defining at least one side-wall and at least first and second layers disposed on the substrate including the side-wall, at least one of the layers comprising a conductive thin-film including a portion extending beyond the side-wall and defining an exposed emitter edge from which electrons are emitted. In general, the layers are substantially parallel to each other and to the side-wall. Several embodiments of this aspect of the invention exist. In one embodiment at least one of the layers comprises an electrically insulating layer for providing, in addition to electrical insulation, mechanical support for the conductive thin-film and for enabling the removal of heat from that film. Advantageously, a pair of such insulating layers can be disposed on opposite sides of the conductive thin-film. In another embodiment, all of the layers are conductive and, advantageously, a pair of electrically conductive layers are disposed on opposite sides of the conductive thin-film for providing mechanical support for the conductive thin-film as well as an increased current carrying capability. Furthermore, the additional conductive layer or layers can be comprised of different conductive materials than the conductive thin-film. Advantageously, although not absolutely required for the practice of this invention, the side-wall of the non-flat portion extends in a substantially vertical direction with respect to the essentially horizontal portion of the substrate.

According to a second aspect of the invention, a gated thin-film edge field emitter device is provided which is capable of low voltage operation. This device includes a substrate having a substantially horizontal portion and a non-flat (raised) portion defining at least one side-wall, and at least first, second, third and fourth layers disposed on the substrate including the side-wall and being substantially parallel to the side-wall. Although not absolutely required for the practice of this invention, the side-wall is substantially perpendicular to the horizontal portion of the substrate. Two of the layers are thin conductive films each having a portion extending beyond the side-wall and defining an exposed edge; one of these two layers comprises an extraction gate while the other is an emitter layer with the exposed edge of this emitter layer being an edge emitter from which electrons are emitted. The other two of the four layers are electrically insulating layers on opposite sides of the emitter layer between the layer which is the extraction gate and the substrate side-wall. The substrate, non-flat (raised) portion thereof, and side-wall thereof are not absolutely required for this invention, except in a particular embodiment described further below, in which these elements constitute an extraction gate.

In two embodiments of the gated structure, a fifth layer comprising thin conductive film is disposed on the non-flat (raised) portion of the substrate and substantially parallel to it, this fifth layer having an edge portion extending beyond the side-wall and defining an exposed edge. In these embodiments, the first and fifth layers comprise extraction gate layers, the second and fourth layers comprise electrically insulating layers and the third layer comprises an emitter layer, and, as noted above, the embodiments differ in that in one embodiment the insulating layers need not have the same thickness while in the other these layers are of substantially the same thickness.

In a third embodiment of the gated structure, the substrate is conductive, as stated above, and the non-flat (raised) portion of the substrate, i.e., that defining the side-wall, comprises a further extraction gate of the device.

These gated emitter devices include structural features in common with the ungated devices described above and in this regard, although not absolutely required for the practice of this invention, the side-wall (raised portion) is substantially vertical with respect to the horizontal portion of the substrate and the layers are substantially parallel to the side-wall. In both the gated and ungated devices, the electrically insulating layers are advantageously comprised of $SiO_2$ and the conductive thin-film layers of platinum, although, as discussed below, other materials can be used.

A further aspect of the invention concerns methods of making the devices described above. A preferred method of forming a gated thin-film edge film emitter device includes the steps of forming a substrate with a horizontal part and a non-flat (raised) portion defining at least one side-wall substantially vertical with respect to the horizontal part, and conformally depositing at least four layers on the substrate such that these layers each include a portion extending substantially parallel to the side-wall of the substrate. The four layers comprise alternating layers of electrically conductive and insulating material, and the method further comprises removing an upper part of the portion of each of the insulating layers that extends substantially parallel to the side-wall of the substrate so as to expose the upper edges of the corresponding portions of the conductive layers which edges then serve to form an emitter and at least one extraction gate.

In making the devices of the first two embodiments described above, three of the four layers are deposited on the substrate before depositing the fourth layer. The three layers comprise one conductive layer between two electrically insulating layers, and in accordance with these two embodiments, the outer surface of the three layers is covered by a masking material, and upper portions of the three layers overlying the side-wall and overlying the top of the raised portion of the substrate are etched away or otherwise removed in a first removal (etching) step.

In the first embodiment, after the etching step, a further upper portion of the non-flat portion of the substrate is etched away or otherwise removed to produce a resultant intermediate structure. Thereafter, the fourth layer, which is conductive, is then deposited over the upper surface of the immediate structure. After first using protective masking, such as with a planarization masking layer, an upper portion of the fourth layer is then etched away or otherwise removed to expose the upper edges of the three layers and to create separate inner and outer parts of the fourth layer. Thereafter, the upper portions of the electrically insulating layers between the inner part, the one conductive layer and the outer part are then removed, e.g., etched away.

In the second embodiment, upper portions of the two electrically insulating layers of the three layers are removed to expose an upper portion of the one conductive layer so as to produce a first intermediate structure. A further electrically insulating layer is then deposited on the upper surface of the first intermediate structure, with portions of this further insulating layer then being removed to provide a further intermediate structure including electrically insulating layers of the same thickness on opposite sides of the one conductive layer. The fourth layer, which is conductive, is then deposited over the upper surface of the further intermediate structure, and after appropriate planarization masking, an upper portion of the fourth layer is selectively etched away or otherwise removed to form inner and outer parts of the fourth layer which constitute the extraction gates of the emitter device.

In the third embodiment, the substrate comprises a conductive material as mentioned above, and the four layers are deposited in sequence, on top of each other, over the substrate including the side-wall. Upper portions of the four layers are then removed to expose the upper ends of portions of the four layers extending substantially parallel to the side-wall, so that the aforesaid etching of the insulating layers between the conductive layers exposes upper edge portions of the conductive layers.

FEAs constructed using emitter devices in accordance with the invention can be used for a variety of vacuum transistors, vacuum microelectronic analog and digital devices, and as modulated or cold electron sources. Additionally, such FEAs are of potential use for a new class of flat panel displays, including eyeglass displays, wrap-around displays, VLSI circuits, fuses, switches, and the like.

BRIEF DESCRIPTION OF THE DRAWINGS

These and other objects, features and advantages of the invention, as well as the invention itself, will become better understood by reference to the following detailed description when considered in connection with the accompanying drawings wherein like reference numerals designate identical or corresponding parts throughout the several views, and wherein.

DETAILED DESCRIPTION OF THE PREFERRED EMBODIMENT

Figure 1:
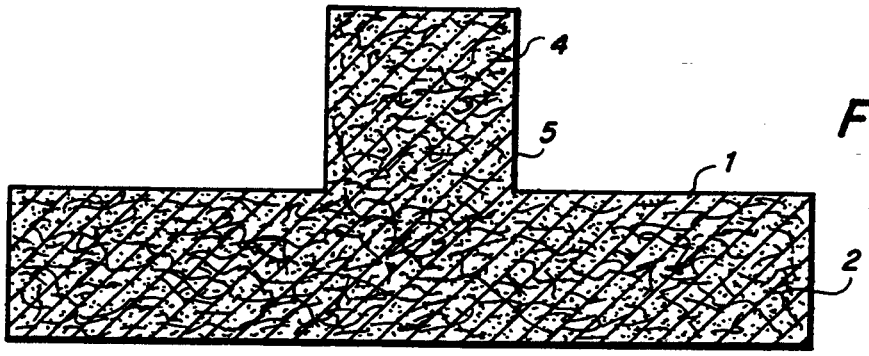
FIG. 1 is a cross-sectional view of a substrate, including a horizontal portion and a non-flat (raised) portion used in one embodiment of the invention.

As discussed above, the present invention is generally directed to FEA structures and devices and to methods of manufacture therefor and, in particular, to thin-film edge field emitters that use the sharp edges of vertical conductive thin-films to provide electron emission. By way of a brief introduction, it is noted that in accordance with one preferred embodiment, the emitters are integrally gated although, as described below, ungated emitters are also provided. Also, in accordance with a preferred embodiment of the method of the invention, the emitter structures and devices are manufactured using chemical beam deposition (CBD) processes to deposit conformal conductive thin-films which constitute the edge emitters of the devices. Flat or horizontal edge field emitters are disclosed in U.S. Pat. No. 5,214,347, issued on May 25, 1993 to Henry F. Gray and entitled "Layered Thin-Edged Field-Emitter Device," which application is hereby incorporated by reference.

CBD techniques used to produce thin substantially vertical metal structures on a substrate are disclosed in U.S. Pat. No. 5,110,760 (Hsu), particularly Step S2 as described in the Specification from column 3, line 17 through column 5, line 40, and in Hsu, et al, "20 Nm Linewidth Platinum Pattern Fabrication Using Conformal Effusive-Source Molecular Precursor Deposition and Sidewall Lithography", J. Vac. Sci. Technol. B10(5), Sep/Oct 1992, pp. 2251–2258. The CBD technique is a process for depositing a metallic layer on an exposed surface. The CBD technique has the following features: (1) conformal deposition of material regardless of the orientation or shape of the exposed surface, (2) deposition of very thin films, on the order of 100–300 Å, and (3) production of films having a small grain size, on the order of the film thickness. The first feature (conformal deposition) is effective in maintaining a constant film thickness over a surface which is not necessarily flat. Such a conformal film thickness avoids thermal damage which would otherwise result from electrical conduction through nonuniform conducting material. The second feature (thinness) is basic to the creation of the field emitter of the present invention, since a sharp edge provides a radius of curvature on the order of 100 Å. The third feature (small grain size) arises since the field emitter demands a small radius of curvature, and any large grains would result in a variations of the radius of curvature of the field emitter. Furthermore, large grains might result in a rough surface. The CBD technique also can be used with alloys, thereby permitting the use of a wide variety of conducting materials, such as those that are more resistant to oxidation or those that provide a low work function.

The field emitter electrode of the present invention has a small radius of curvature because the emitter layer itself is thin, on the order of 200–300 Å. The field emitter electrode is resistant to blunting through repeated operation of the device, such as by ion sputtering or other processes that would tend to blunt other types of field emitters. Ion sputtering, as might occur through normal usage of the field emitter device, would merely reduce the height, but would not affect the radius of curvature of a field emitter electrode according to the present invention.

Referring now to the drawings and, more particularly, to FIG. 1 which shows a first step in an exemplary process for manufacturing a thin-film edge emitter, in order to create what is generally referred to as a "raised template," the flat or horizontal surface 1 of a substrate 2 has a protuberance 4 formed thereon having substantially vertical side-walls 5. In being substantially vertical, the side-walls 5 preferably extend at an angle of at least 85° from the flat or horizontal surface 1, and most preferably, at an angle of substantially 90°. In this example, the formation of a cylindrical template or protuberance 4 is shown. Because of its superior electrical and mechanical properties, such a cylindrical structure is preferred, but it is not absolutely required for the practice of this invention, and is merely illustrative. Other shapes, such as those having flat vertical surfaces and those having vertical corners, can also be readily used. Furthermore, the side-walls 5 can be the walls of a trough or recess rather than a protuberance or abutment.

As discussed further below, the protuberance 4 serves as a mold on which layers are deposited. In fabricating the field emitter device of the present invention, the protuberance 4 can be partially or totally removed. In general, it is not needed as part of the structure of the field emitter device, and it is immaterial whether or not any part of protuberance 4 remains in the final structure, unless it is used as part of an extraction gate electrode, as discussed earlier.

The substrate 2 used for fabrication of the emitter can be made of conducting or non-conducting material and is most typically a silicon wafer. Protuberance 4 can be made by a number of conventional fabrication techniques based on, for example, photolithography. The side-walls 5 of the protuberance 4 may be formed at any angle to the substrate surface, but are, most preferably, vertical, i.e., substantially perpendicular to the substrate surface. Accordingly, the side-walls 5 are substantially vertical with respect to horizontal surface 1. As discussed further below, substantially vertical side-walls 5 are advantageously used in conjunction with one or more later steps of directionally selective etching in a direction parallel to the side-walls 5 and perpendicular to the horizontal surface 1. If the side-walls were not substantially parallel to the direction of etching, then material might be disadvantageously removed. Alternatively, this field emitter device could be effectively fabricated using isotropic (non-directional) etching, in which case the angle of the side-wall 5 with respect to the flat or horizontal surface 1 would not be as critical.

Figure 2:
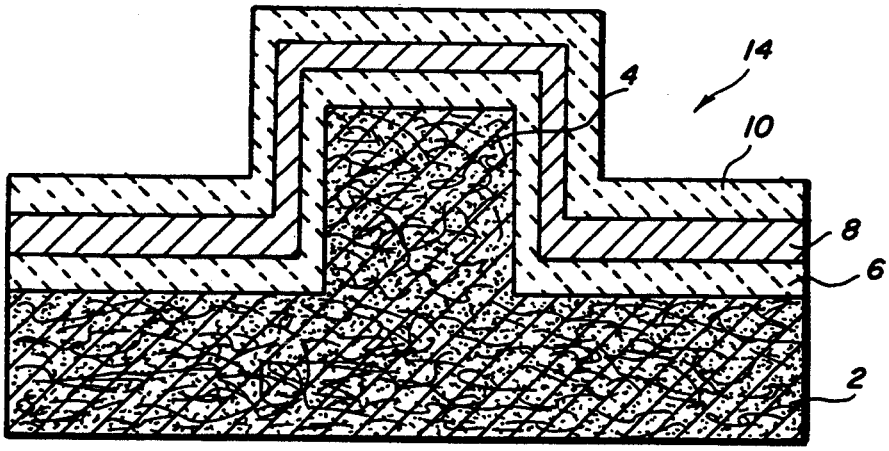
FIG. 2 is a cross-sectional view of a structure formed by depositing two insulating layers and a conducting layer on the substrate of FIG. 1.

In the exemplary embodiment of the invention under consideration, as shown in FIG. 2, a thin-film layer of a dielectric or electrically insulating material 6 is first deposited, for example, by chemical vapor deposition (CVD) techniques, or thermally grown on substrate 2. A conducting material layer 8 is then deposited or disposed on film layer 6, preferably using CBD techniques. Layer 8 will ultimately become the emitter. Thereafter, a second electrically insulating layer 10 is deposited on conducting material layer 8 to form a structure 14. The second insulating layer 10 may be of the same material as or a different material from the first layer 6. Typically, the thickness of the insulating layers 6 and 10 is about 0.1–0.5 μm and the preferred dielectric material is $SiO_2$. A typical thickness for the conducting layer 8 is 200–300 Å and the preferred conducting material is platinum although other materials can be readily used. For example, the conducting layer 8 that ultimately forms the emitter can also comprise homogenous alloys which do not oxidize easily or which have a relatively low work function, such as homogenous platinum alloys, osmium alloys and barium alloys. Furthermore, although CVD is the preferred technique for depositing the electrically insulating layers, other methods can also be used to produce such thin layers. For example, a combined method can be used wherein a silicon layer (to be used as the emitter layer) is deposited using CVD and the layer is then thinned by oxidizing the layer.

Figure 3:
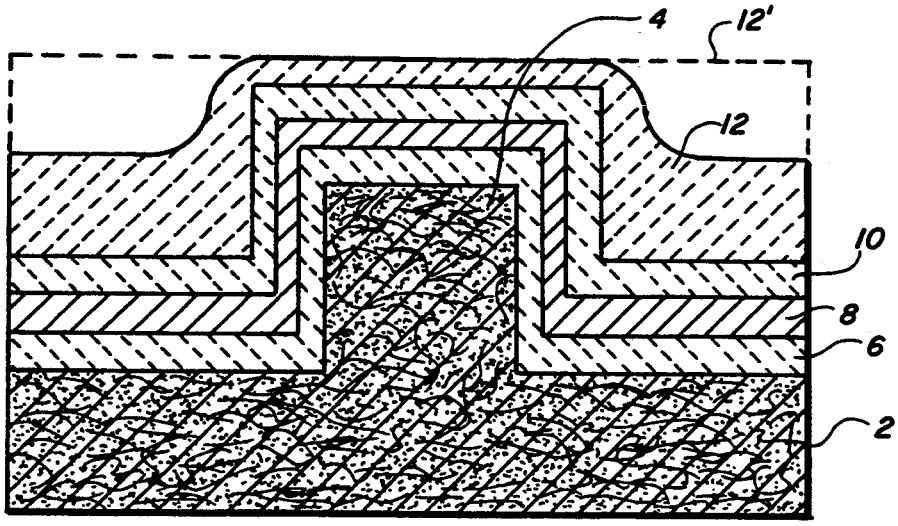
FIG. 3 is a cross-sectional view of the structure of FIG. 2 with a substantially planarized masking layer deposited on the structure.

A masking step is provided next and in the exemplary embodiment shown in FIG. 3, a planarization masking layer 12 is applied over the conducting and insulating layers 6, 8 and 10. As shown, the planarization masking layer 12 roughly conforms to the shape of the underlying structure and is relatively thicker in the area of the side-walls and lower horizontal surface than in the area of the upper surfaces. The planarization masking layer can also be an actual planar layer as indicated at 12', this latter technique thus being closer to true "planarization." The material used in forming the planarization masking layer 12 can be one of a variety of planarization materials such as photoresists, polyimides or spin-on glasses. The planarization masking layer enables the deposited layers to be selectively removed from the top of raised template or protuberance 4, thereby eliminating the need for high spatial resolution lithography techniques which are both expensive and difficult to perform in the sub-micron regime.

Figure 4:
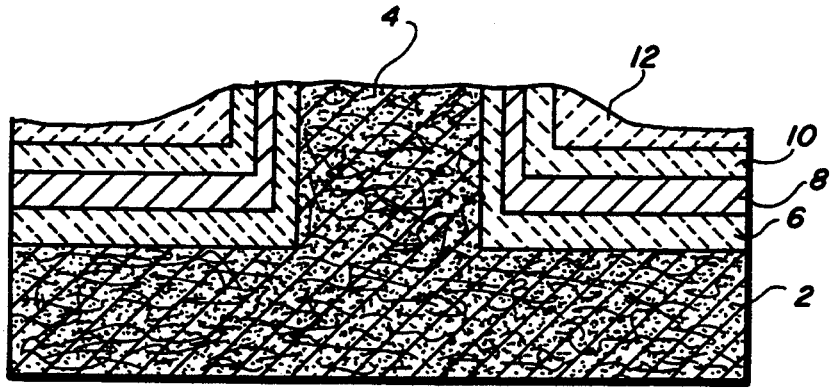
FIG. 4 is a cross-sectional view of the structure of FIG. 3 after etching away the upper part of the insulating layers, the conducting layers, and the planarization masking layer.

Overlying portions of layers 6, 8 and 10 and part of the planarization masking layer 12 (12') are then removed to yield the remaining structure as shown in FIG. 4. These portions are removed by any of a variety of removal techniques such as reactive ion etching (RIE), sputter etching, or wet etching. The removal is preferably directionally selective in the direction perpendicular to the flat or horizontal portion 1 and parallel to the side-wall 5. Such directionally selective removal would be effective with either planarization masking layer 12 or 12'. Alternatively the removal could be isotropic (non-directionally selective), and planarization masking layer 12 would be more effective for such isotropic removal than layer 12', in permitting better removal of portions of layers 6, 8 and 10 as desired, since planarization masking layer 12 would cover more of the structures which are not to be removed, as shown remaining in FIG. 4.

Figure 5:
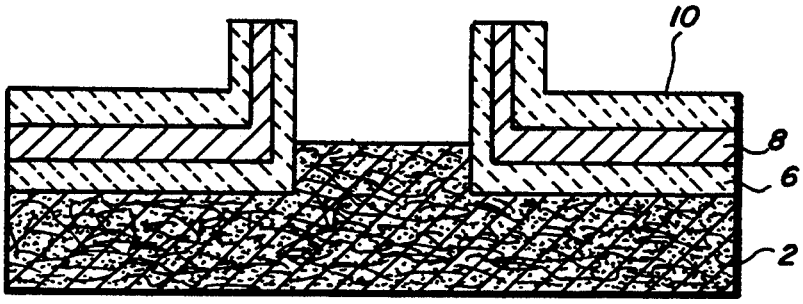
FIG. 5 is a cross-sectional view of the structure of FIG. 4 after etching away an upper portion of the raised part of the substrate.

One or more further etching steps are then used to remove the remaining part of layer 12 or 12', and to remove the upper portion of the raised template or protuberance 4, without removing the adjacent vertically extending thin-film insulators 6 and 10 and conductor 8. The result is shown in FIG. 5. The remaining part of layer 12 or 12' is removed by any of a variety of known means, such as by the use of an oxygen plasma (a gaseous process) or a solvent, such as acetone. The partial removal of protuberance 4 can be accomplished by selective RIE or wet etching.

Figure 6:
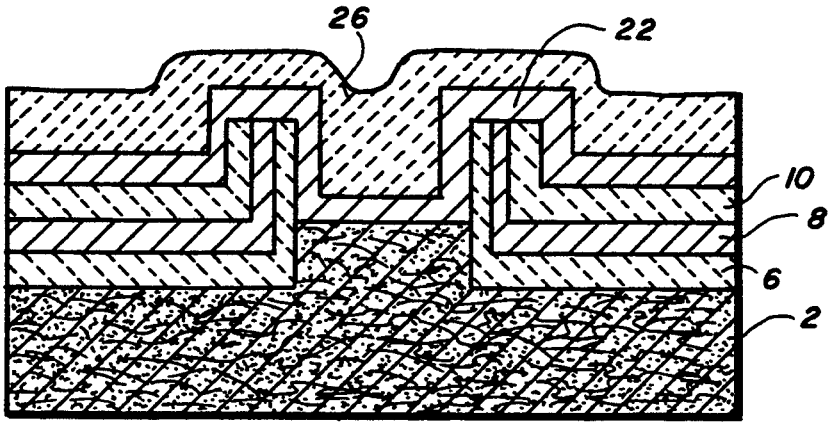
FIG. 6 is a cross-sectional view of the structure of FIG. 5 after the deposition, on the upper surface thereof, of a conductive layer and a planarization masking layer.
Figure 7:
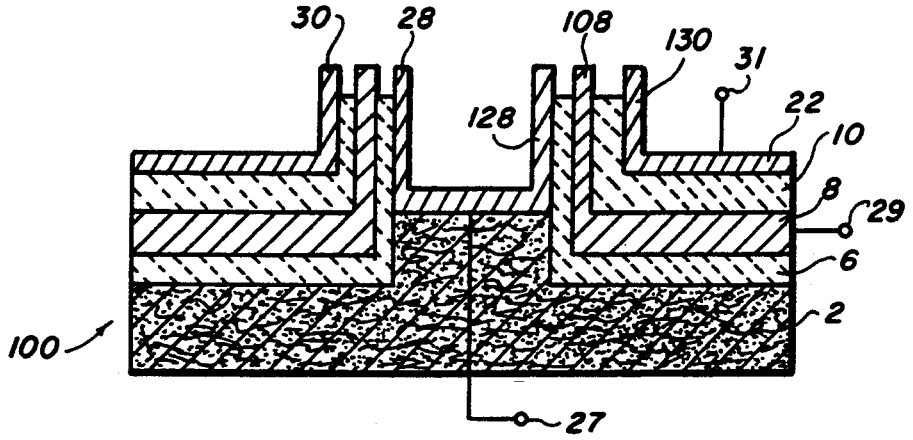
FIG. 7 is a cross-sectional view of a gated field emitter device formed by selectively etching the structure of FIG. 6.

FIGS. 6 and 7 show intermediate and final steps in producing the gated field emitter structure. As shown in FIG. 6, a further thin layer 22 of conducting material is deposited over the upper surface of the structure of FIG. 5 to produce the resulting structure shown in FIG. 6. Preferably, the conducting material 22 is platinum. Conducting layer 22 will become the extraction gate electrodes and can be deposited by any of a variety of deposition means, such as CVD or CBD. The multi-layer structure is then covered by a planarization masking layer 26 of inert material similar to layer 12 (or 12') described above.

Part of planarization masking layer 26 and top portions of the multi-layer structure of FIG. 6 are removed by directional etching (such as RIE or sputtering) so as to produce a structure which includes a central cylindrical conducting layer 8 having a substantially vertical portion 108, which vertical portion 108 acts as the field emitter, and to produce two cylindrical electrically insulating layers 6 and 10, also known as "gate oxide" layers, on either side of conducting layer 8. Furthermore, when the upper portion of conducting layer 22 is etched away there is produced an inner, generally cupshaped, conducting portion 28 having a substantially vertical portion 128 and an outer cylindrical conducting layer 30 having a vertical portion 130, and these vertical portions 128 and 130 form the extraction gate electrodes or electron extraction electrodes of the emitter device.

As with removal of planarization masking layer 12 or 12', the removal of planarization masking layer 26 and top portions of the multilayer structure of FIG. 6 is preferably directionally selective in the direction perpendicular to the flat or horizontal portion 1 and parallel to the side-wall 5. Such directionally selective removal would be effective with planarization masking layer 26 being substantially a plane or being as shown in FIG. 6. Alternatively, the removal of planarization masking layer 26 could be isotropic (non-directionally selective), and then planarization masking layer 12 would be more effective as shown in FIG. 6 than if it were planar, in order to permit better removal of portions of layers 6, 8 10 and 22 as desired.

Portions of the exposed insulators 6 and 10 are then removed, e.g., by selective RIE, to allow the upper edges of conductors 8, 28 and 30 to project or protrude above the insulators 6 and 10 and thereby expose these conductors, yielding the structure shown in FIG. 7. In the operation of this device, the upper edges of conductors 8, 28, and 30 are separated by a vacuum.

In the gated emitter structure just described, an electrical connection to inner extraction gate or grid 28 is made through the original substrate material 2 as is illustrated schematically by connection 27, while connections to the emitter 8 and the outer extraction gate or grid 30 are indicated schematically at 29 and 31, respectively. As discussed above, in applications where the substrate is conductive, substrate 2 can be made of any type of conducting material which has selective etching properties with respect to the other materials used or can be made of an electrically insulating material with a thin metal layer thereon.

The gated field emitter device 100 shown in FIG. 7 thus includes a substantially flat thin film emitter layer 108, and one or more substantially flat thin film extraction gate layers 128 and 130 substantially parallel to the emitter layer 108. Although not absolutely required for the practice of this invention, the emitter layer 108 and one or more extraction gate layers 128 and 130 are substantially perpendicular to a flat portion 1 of a substrate 2. The emitter layer 108 and one or more extraction gate layers 128 and 130 are separated by one or more electrically insulating layers 6 and 10 except for exposed edges of layers 108, 128 and 130. In the operation of the device 100 as a gated field emitter, the exposed edge of emitter layer 108 has a small radius of curvature and emits electrons. The exposed edges of one or more extraction gate layers 128 and 130 are separated from the exposed edges of emitter layer 108 by a vacuum and the one or more extraction gate layers 128 and 130 act as extraction gate electrodes. The exposed edge of emitter layer 108 typically has a radius of curvature of about 100–150 Å or less, and is typically separated from the extraction gate electrodes 128 and 130 by about 0.1–0.5 μm. This gated field emitter device 100 can be operated with a potential difference between the emitter layer 108 and the extraction gate electrodes 128 and 130 of 150 Volts (V) or less, and since the electric field in the region between the emitter layer 108 and the extraction gate electrodes 128 and 130 is then on the order of $3\text{–}5*10^7$V/(centimeter (cm)$^2$), the device 100 would effectively emit electrons in the general direction parallel to the emitter layer 108 and away from the insulator layers 6 and 10. In a typical structure, the emitted electrons would be attracted to and collected by an anode electrode (not shown).

Figure 8:
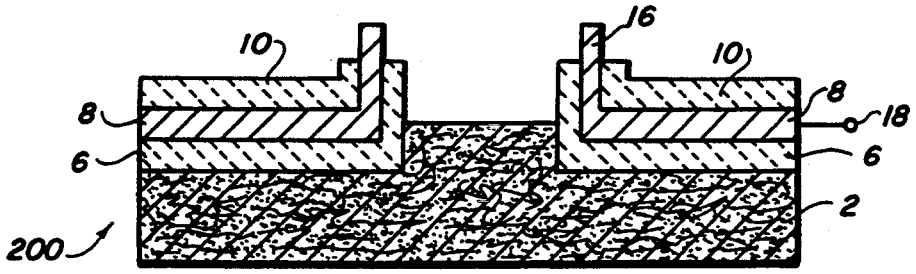
FIG. 8 is a cross-sectional view of an ungated emitter device formed by selectively etching the structure of FIG. 5.

Referring now to FIG. 8, an ungated emitter structure 200 in accordance with a preferred embodiment of the invention is shown. It will be appreciated that the structure shown in FIG. 8 is similar to that of FIG. 5 and thus can be fabricated in a similar manner, except that the upper portions of the electrically insulating layers 6 and 10 have been removed to expose the upper emitter edge 16 of conductive film layer 8 and an electrical connection is made to conductive layer 8 as is schematically indicated at 18. The emitter structure of FIG. 8, which can be used in diode applications, can be particularly useful in a so-called "bed of nails" configuration, i.e., a FEA where a large number of upwardly projecting field emitters ("nails") are provided over a relatively large surface area in spaced relation to an overlying conductive plate (not shown) which constitutes the anode of the FEA diode. As mentioned above, the parallel processing capabilities of the invention enable a large number of the emitters of the array to be produced at the same time, rather than having to produce the field emitters individually or in small groups.

In the embodiment illustrated in FIG. 8, insulators 6 and 10 provide mechanical rigidity or stability so as to enable the thin-film emitter 8 to extend a substantial distance above the substrate, i.e., impart enhanced mechanical strength to the sandwich construction of the film 8 and insulators 6 and 10. In addition, insulators 6 and 10 enhance heat removal from the device.

The ungated structure 200 of FIG. 8 differs from the gated structure 100 of FIG. 7 in that it does not have any extraction gate electrodes. In the operation of ungated emitter device 200 shown in FIG. 8, the emitter emits electrons from the exposed part of the conductive film layer 8 in the direction generally away from insulating layers 6 and 10.

Figure 9:
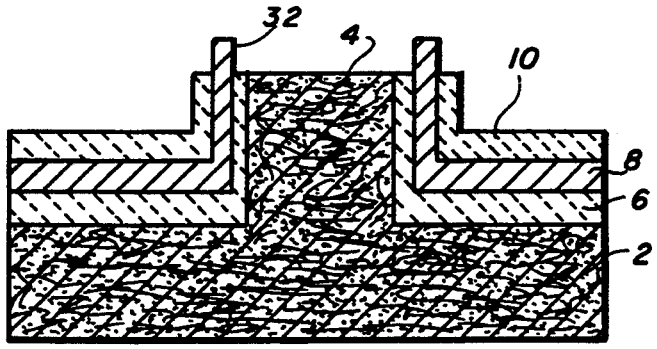
FIG. 9 is a cross-sectional view of an intermediate structure formed, during a method in accordance with a second embodiment of the present invention, from the structure of FIG. 4.
Figure 10:
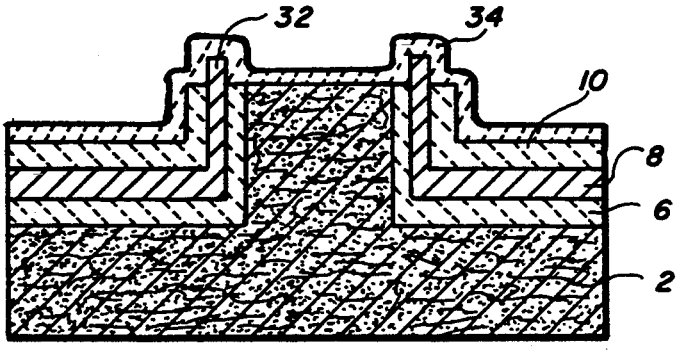
FIG. 10 is a cross-sectional view of the structure of FIG. 9 after the deposition of a further insulating layer on the upper surface thereof.
Figure 11:
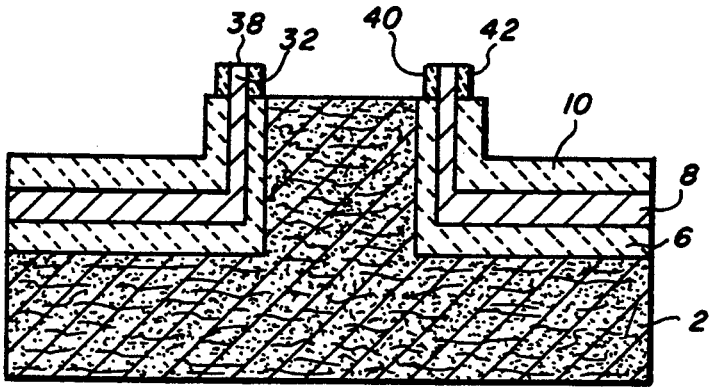
FIG. 11 is a cross-sectional view of the structure of FIG. 10 after etching away part of the further insulating layer.
Figure 12:
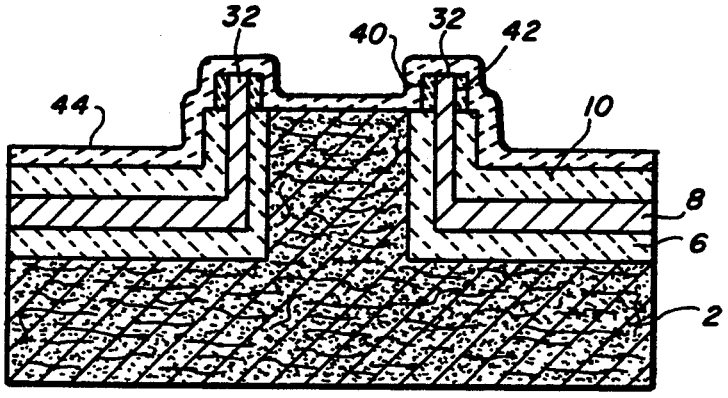
FIG. 12 is a cross-sectional view of the structure of FIG. 11 after the deposition of a further conducting layer on the upper surface.
Figure 13:
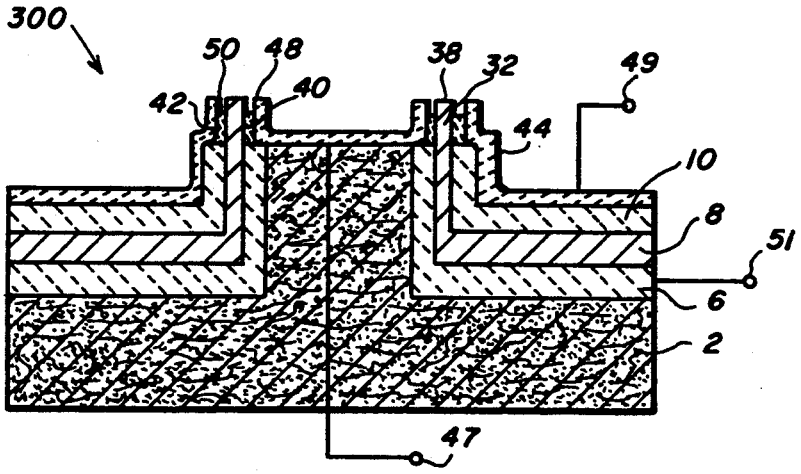
FIG. 13 is a gated emitter device formed by selectively etching the structure of FIG. 12.
Figure 14:
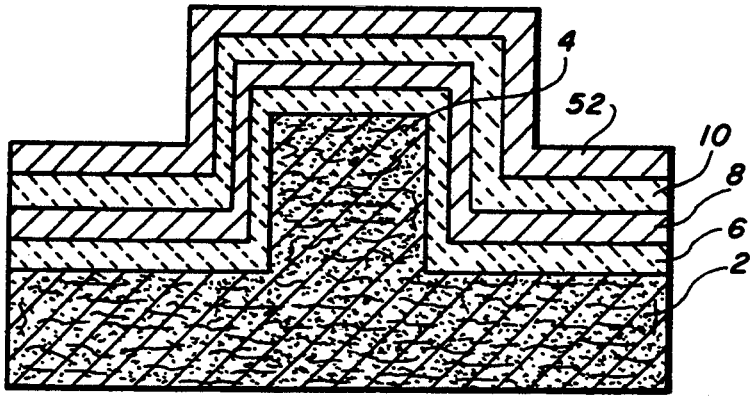
FIG. 14 is a cross-sectional view of a structure formed, during a method in accordance with a third embodiment of the present invention, by depositing a further conductive layer on the upper surface of the structure of FIG. 2.

Referring now to FIG. 9, in accordance with a method for fabricating a second, symmetrical embodiment of the gated emitter structure, the method is similar to that described above up to the production of the structure shown in FIG. 4. Thereafter, the electrically insulating layers 6 and 10 of the structure shown in FIG. 4 are etched away at the upper regions to expose the upper edge portion 32 of central conducting film layer 8, using standard selective etching techniques. Next, as shown in FIG. 10, at least one additional electrically insulating layer 34 is deposited over the entire upper surface of the structure thereby covering emitter film edge 32. Layer 34 will ultimately be used to provide the required extraction gate insulation. In this regard insulating layer 34 is next etched away, as shown in FIG. 11, to expose the upper edge 38 of emitter film edge portion 32 and to leave inner and outer extraction gate insulator layers 40 and 42 of equal thickness surrounding, i.e., on opposite sides of, conductive film layer 32. In the next step, a conductive layer 44 is then conformably deposited over the upper surface of the structure as shown in FIG. 12. Planarization and etching procedures similar to those discussed above are then used so that the final gated field emitter structure 300 is as shown in FIG. 13. In particular, as illustrated, the resultant gated emitter structure is formed by etching away the upper edge portions of conductive layer 44 and selectively etching away parts of the insulators 40 and 42 between vertically extending inner and outer parts of conductor 44 and the central emitter portion 32 so as to thereby create an upper exposed edge 38 of emitter layer 8 and to also create inner and outer exposed upper edges 48 and 50 from the metal layer 44 on the opposite sides of edge 38. As shown in FIG. 13, appropriate electrical connections are provided as indicated schematically by the connections 47, 49 and 51. In this embodiment, the emitter-extraction gate structure is symmetrical in that the two extraction gates formed from metal layer 44 are separated from the emitter or cathode 38 by insulators 40 and 42 which are of equal thickness because they are formed from the same insulating layer 34 in the manner described above.

The structure of the gated field emitter device 300 shown in FIG. 13 differs from the gated field emitter device 100 shown in FIG. 7, if at all, in the relative thickness of conductive upper edges 48 and 50 of device 300 (FIG. 13) as compared with the relative thickness of gate layers 128 and 130 of device 100 (FIG. 7), and the relative thickness of insulator layers 40 and 42 of device 300 (FIG. 13) as compared with the relative thickness of insulating layers 6 and 10 of device 100 (FIG. 7). Because the conductive exposed edges 48 and 50 of device 300 are made from the same conductive layer 44, they have substantially the same thickness. Because the insulator layers 40 and 42 of device 300 are made from the same insulator layer 34, they also have substantially the same thickness. The corresponding structures of gated field emitter device 100 (FIG. 7) need not necessarily have the same thickness.

Figure 15:
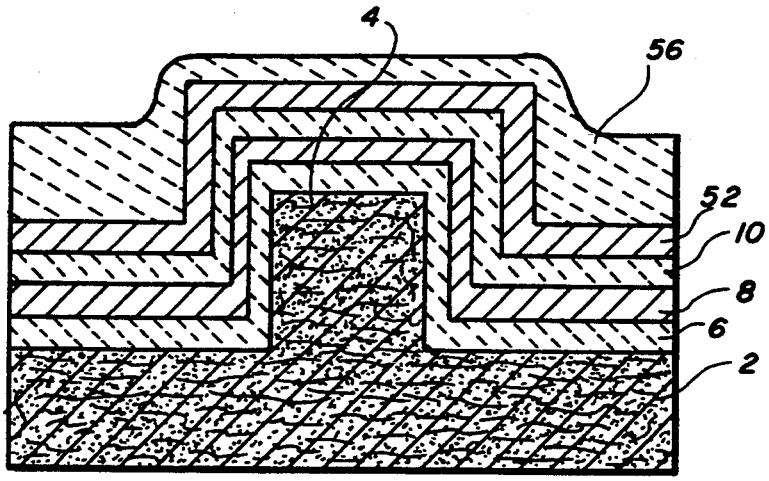
FIG. 15 is a cross-sectional view of the structure of FIG. 14 after the addition of a planarization masking layer.
Figure 16:
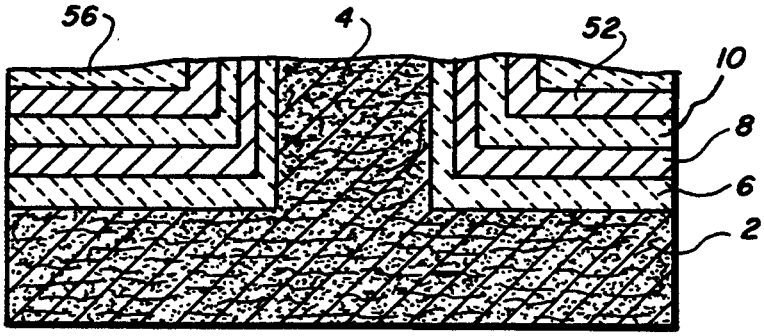
FIG. 16 is a cross-sectional view of the structure of FIG. 15 after etching away part of the insulating and conducting layers of the structure of FIG. 15.
Figure 17:
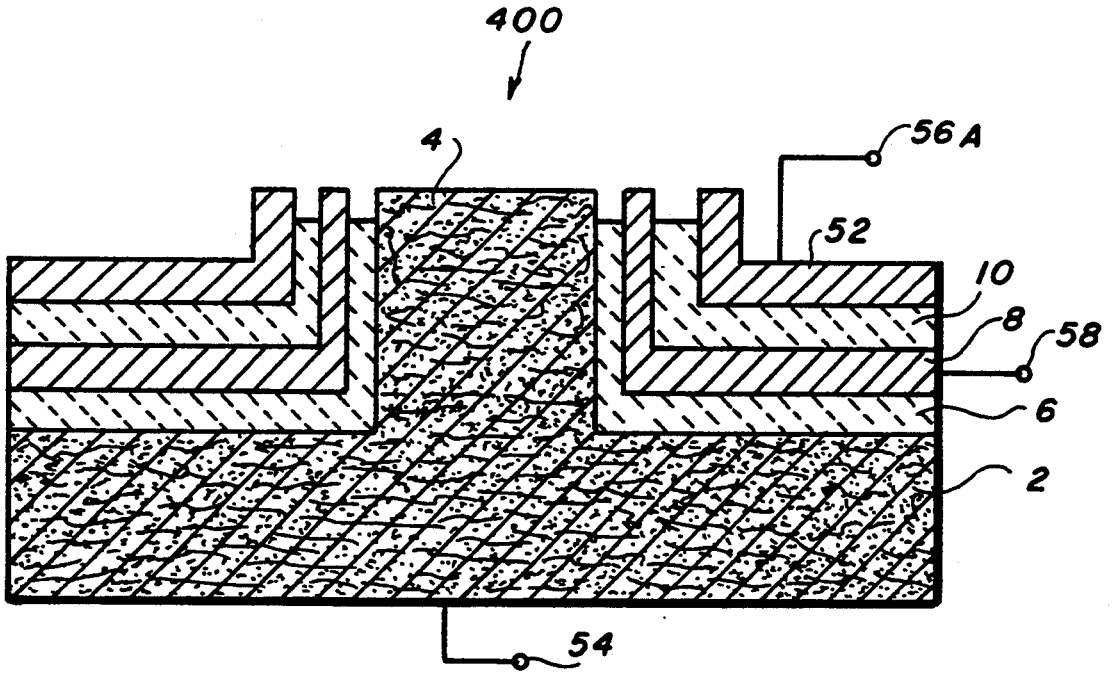
FIG. 17 is a cross-sectional view of a gated field emitter device formed by selectively etching away portions of the structure of FIG. 16.

Turning now to the consideration of a third embodiment of the gated emitter device of the invention, and referring to FIGS. 14 to 17, in this embodiment, as will be evident from the discussion below, the protuberance or raised template 4 is used as one extraction gate and the overall process can thus be simplified. Unlike the other embodiments described above, this embodiment must include a conductive substrate 2 with protrusion 4 and side-wall 5. The method of fabrication begins with the structure shown in FIG. 2 and an additional conducting layer 52 is conformably deposited over the upper surface of the basic structure of FIG. 2. This results in the four layer "sandwich" structure shown in FIG. 14. Most preferably, the additional conducting layer 52 is platinum. The structure is then planarized as described above by applying a masking or resist material such that the resultant resist layer 56 produced is thicker above the lower horizontal surfaces and along the sides than above the top of the structure, as shown in FIG. 15. The top of the basic structure shown in FIG. 15 is then removed by using, e.g., ion beam sputtering, RIE or any directed or isotropic removal technique, so as to produce the structure shown in FIG. 16, wherein the upper edges of the insulating layers 6 and 10 and conducting layers 8 and 52 are exposed. A hydrogen fluoride (HF) etch, RIE or any suitable technique is then used to remove an additional portion of insulating layers 6 and 10, and finally, the resist layer 56 is removed to produce the structure shown in FIG. 17. The exposed edge of inner cylindrical film 8 serves as the field emitter or cathode of the device, while the central raised template or protuberance 4 and outer conducting layer 52 serve as the extraction gates. As shown in FIG. 17, appropriate electrical connections are provided as indicated schematically by the connections 54, 56 and 58. For example, the electrical connection to conductive film layer 8 can be in the form of contact pad connection obtained by etching or ion-milling a portion of layers above layer 8.

In a field emitter device according to the present invention, one or more additional conductive layers (not shown) may be disposed on the sides of emitter layer 8 (FIGS. 7, 8, 13, and 17). These additional conductive layers do not extend to the emitting edge of the emitting layer 8. The one or more emitting layer 8 and one or more additional layers together form the electron emitting portion of the device. The one or more additional conductive layers provide enhanced mechanical strength as well as increased current carrying capability. Since the one or more additional layers do not extend to the emitting edge of the emitting layer 8, they do not increase the radius of curvature of the emitting edge and therefore do not interfere with electron emission.

It will be appreciated from the foregoing that while with prior art FEAs a mask was previously required to define the aperture size and to determine the height of the field emitter, in the device of the present invention, the radius of curvature of the field emitter and the spacing between the extraction gates and the emitter are determined by the deposition thickness employed, i.e., the thicknesses of the constituent films forming the device. Moreover, as mentioned previously, since the size of the area to be manufactured is no longer limited by a high spatial resolution lithography process, a large area of field emitters may be manufactured simultaneously using so-called parallel processing techniques. In this regard, all steps, with the exception of the planarization steps, may be performed in a single gaseous chemical beam etching and deposition chamber. Consequently, high spatial registration or masking and the use of high spatial resolution lithography required with conventional techniques are eliminated, thereby enabling, as discussed above, the inexpensive fabrication of large areas of field emitters in a single step.

The process can be carried out on a variety of substrates including conducting and non-conducting substrates as well as film substrates and the like, depending on the application. In addition, the array of field emitters produced can be made in a variety of patterns such as parallel straight lines, crossing lines, patterned lines, orthogonal lines, off-orthogonal lines, segments of lines and the like. Furthermore, protective resistive films can be easily applied to each device. The manufacturing costs should be extremely small and area uniformity should be excellent. Both thick and thin-films can be mixed to provide current sharing, mechanical strength, and protection from "tip blowup."

The substrates can be made in sheet form and the protuberances or raised templates can be molded, formed, bent or made into virtually any shape or size. Forms or molds for the protuberances for the thin-film edge field emitters can be easily made by the same methods used to make phonograph records or beverage bottles, namely a stamp-and-go process. Hence the substrates could be stamped out, used to form the structures, and then maintained or etched away. This would provide a very economical means for the manufacture of inexpensive HDTV screens or other large area uses such as high voltage switches, electrostatic discharge (ESD) protection devices, a new class of Xerox type copy machines, cathodes for e-beam welders, CRTs, linear beam tubes, shaped cathodes such as Pierce cathodes, flat panel monitors, "eyeglass" displays, wrap-around displays for automobile or aircraft displays, and the like.

It is also envisioned that semiconductors, cermets, compounds which are both conducting and non-conducting, overlayers, and the like can also be used in the present invention.

Although the present invention has been described relative to specific exemplary embodiments thereof, it will be understood by those skilled in the art that variations and modifications can be effected in these exemplary embodiments without departing from the scope and spirit of the invention.

An example of another embodiment within the scope of this invention is a thin-film edge field emitter device which includes at least two layers disposed on the substrate as described earlier. The at least two layers are on the side-wall, at least one of the at least two layers including a conductive thin-film including a portion extending beyond the side-wall and defining an exposed emitter edge suitable for emitting electrons. Just as with the embodiments described above in detail, this embodiment may include various features, such as having conductive layers, insulating layers, and additional layers. This device is fabricated by methods similar to the methods described earlier, as readily determined by a person of ordinary skill in the art.

What is claimed is:

1. A thin-film edge field emitter device comprising:
(a) a substrate having a first portion and having a protuberance extending from said first portion, said protuberance defining at least one side-wall, said side-wall constituting a second portion; and
(b) at least two layers disposed on said substrate including said second portion, wherein at least one of said at least two layers comprises a conductive thin-film including a portion extending beyond said second portion and defining an exposed emitter edge.

2. The thin-film edge field emitter device of claim 1, wherein said at least two layers comprise conductive thin-films.

3. The thin-film edge field emitter device of claim 1, wherein at least one of said at least two layers comprises an electrically insulating layer.

4. The thin-film edge field emitter device of claim 1, further comprising a pair of electrically insulating layers disposed on opposite sides of said conductive thin-film.

5. The thin-film edge field emitter device of claim 1, further comprising a pair of conductive layers disposed on opposite sides of said conductive thin-film.

6. The thin-film edge field emitter device of claim 5 wherein said pair of conductive layers comprises conductive thin-films.

7. The thin-film edge field emitter device of claim 5 wherein said pair of conductive layers comprises different conductive material than said conductive thin-film.

8. The thin-film edge field emitter device of claim 1, wherein said second portion extends at an angle of at least 85° from said first portion.

9. The thin-film edge field emitter device of claim 8 wherein said angle is substantially 90°.

10. The thin-film edge field emitter device of claim 1, further comprising a conductive layer disposed adjacent to said conductive thin-film.

11. The thin-film edge field emitter device of claim 1, further comprising an electrically insulating layer disposed adjacent to said conductive thin-film.

12. A thin-film edge field emitter device comprising:
(a) a substrate having a first portion and having a protuberance extending from said first portion, said protuberance defining at least one side-wall, said side-wall constituting a second portion; and
(b) at least four layers disposed on said substrate including said second portion, two of said at least four layers each comprising a thin conductive film including a portion extending beyond said second portion and defining an exposed edge, one of said two layers being suitable for use as an extraction gate and the other of said two layers being suitable for use as an emitter layer, the exposed edge of said layer suitable for use as an emitter layer being suitable for electron emission; and a further two of said at least four layers comprising electrically insulating layers disposed on opposite sides of said layer suitable for use as an emitter layer between the layer suitable for use as an extraction gate and said second portion.

13. The thin-film edge field emitter device of claim 12 wherein said first portion comprises conductive material and said protuberance is suitable for use as an extraction gate.

14. The thin-film edge field emitter device of claim 12 further comprising a fifth layer comprising a thin conductive film disposed on said protuberance including said second portion and having an edge portion extending beyond said second portion and defining an exposed edge, the two outermost layers of said fifth layer and said at least four layers being suitable for use as extraction gate layers, said innermost layer of said fifth layer and said at least four layers comprising said layer suitable for use as an emitter layer, and at least two other layers of said at least four layers being insulating layers.

15. The thin-film edge field emitter device of claim 12 wherein said with respect to second portion extends at an angle of at least 85° from said first portion.

16. The thin-film edge field emitter device of claim 12 wherein said insulating layers are comprised of $SiO_2$ and said conductive thin-film layers are comprised of platinum.

17. The thin-film edge field emitter device of claim 12, further comprising at least four layers disposed on said substrate including said first portion.

18. An integrally gated thin-film edge field emitter device comprising:
(a) a substrate having a first portion, said substrate further including a protuberance which projects from said first portion, said protuberance having at least one side-wall and an upper surface, said side-wall constituting a second portion;
(b) a first extraction gate comprising a first, electrically conductive layer including a portion covering said upper surface and a side conductive portion extending substantially parallel to said second portion, said side conductive portion including an exposed upper edge extending beyond said upper surface, said first extraction gate being suitable for use as an extraction gate;
(c) a first insulator comprising a second, electrically insulating layer including a portion covering said first portion and further including a portion overlying said second portion;
(d) an emitter layer comprising a third, electrically conductive layer overlying said first insulator, said third, electrically conductive layer including a portion extending substantially parallel to said second portion and defining an exposed upper edge, extending beyond said upper surface for emitting electrons therefrom, said emitter layer being suitable for use as an emitter;

(e) a second insulator comprising a fourth, electrically insulating layer overlying said emitter layer; and (f) a second extraction gate comprising a fifth, conductive layer overlying said second insulator and including a portion extending substantially parallel to said second portion and including an exposed upper edge extending beyond said upper surface, said second extraction gate being suitable for use as an extraction gate.

19. An integrally gated thin-film edge field emitter device comprising:

(a) a substrate having a first portion, said substrate further including a protuberance which projects from said first portion, said protuberance having at least one side-wall and an upper surface, said side-wall constituting a second portion, said substrate being suitable for use as an extraction gate;

(b) a first insulator comprising a first, electrically insulating layer including a top portion covering said first portion and further comprising a portion covering said second portion;

(c) an emitter layer comprising a second, electrically conductive layer overlying said first insulator, said second, electrically conductive layer including a portion extending substantially parallel to said second portion and defining an exposed upper edge extending beyond said upper surface of said raised portion for emitting electrons therefrom, said emitter layer being suitable for use as an emitter;

(d) an second insulator comprising a third, electrically insulating layer overlying said emitter layer and;

(e) a second extraction gate comprising a fourth, conductive layer overlying said second insulator and including a portion extending substantially parallel to said second portion and including an exposed upper edge extending beyond said upper surface, said second extraction gate being suitable for use as an extraction gate.

20. A method of forming a thin-film edge film emitter device, said method comprising the steps of:

(a) forming a substrate having a first portion and having a protuberance extending from said first portion, said protuberance defining at least one side-wall, said side-wall constituting a second portion; and (b) conformally depositing at least four layers on said substrate so that said layers each include a portion extending substantially parallel to said side-wall of said substrate, said at least four layers comprising alternating layers of conductive and electrically insulating material, and said method further comprising removing an upper part of said portion of each of said insulating layers extending substantially parallel to said side-wall of said substrate so as to expose the upper edges of said portions of said conductive layers extending substantially parallel to said side-wall to thereby form an emitter and at least one extraction gate.

21. The method of claim 20 further comprising the step of using chemical beam deposition for depositing said layers of conductive material as conductive thin-films.

22. The method of claim 20 further comprising the step of using chemical vapor deposition for depositing said layers of insulating material.

23. The method of claim 20 further comprising the steps of depositing three of said at least four layers on said substrate, depositing said fourth layer of said at least four layers on said substrate after said step of depositing three of said at least four layers, wherein said three layers comprise one conductive layer between two electrically insulating layers, covering the upper surface of said three layers by a masking material, and a first etching step of etching away upper portions of said three layers overlying said side-wall and said protuberance.

24. The method of claim 23 further comprising the step subsequent to said first etching step of etching away a further upper portion of said protuberance to produce a resultant intermediate structure; wherein said step of depositing said fourth layer comprises the step of depositing a conductive fourth layer over the upper surface of said immediate structure, and further comprising the steps of etching away an upper portion of said fourth layer to expose the upper edges of said three layers and to create separate inner and outer parts of said fourth layer, and etching away said upper portions of said insulating layers between said inner part, said one conductive layer and said outer part.

25. The method of claim 23 further comprising the steps of removing upper portions of said two insulating layers of said three layers to expose an upper portion of said one conductive layer so as to produce a first intermediate structure, and depositing a further electrically insulating layer on the upper surface of said first intermediate structure, removing portions of said further insulating layer to provide a further intermediate structure including electrically insulating layers of the same thickness with respect to each other on opposite sides of said one conductive layer, wherein said step of depositing said fourth layer comprises the step of depositing a conductive fourth layer over the upper surface of the further intermediate structure, and further comprising the steps of selectively etching away an upper portion of said fourth layer and selectively etching away parts of said electrically insulating layers of the same thickness to form exposed inner and exposed outer parts of said fourth layer thereby constituting extraction gates of said device.

26. The method of claim 20 wherein said step of forming the substrate comprises the step of forming a conductive substrate, wherein said step of conformally depositing said at least four layers comprises the step of depositing said at least four layer in sequence, over the substrate including said side-wall, and further comprising the step of removing upper portions of said at least four layers to expose the upper ends of portions of said at least four layers extending substantially parallel to the side-wall.

27. An integrally gated thin-film edge field emitter device comprising:

(a) a substrate having a first portion, said substrate further including a protuberance which projects from said first portion, said protuberance having at least one side-wall and an upper surface, said side-wall constituting a second portion;

(b) a first extraction gate comprising a first, electrically conductive layer including a portion covering said first portion and including a side conductive portion extending substantially parallel to said second portion, said side conductive portion including an exposed upper edge extending beyond said upper surface, said first extraction gate being suitable for use as an extraction gate;

(c) a first insulator comprising a second, electrically insulating layer including a portion covering said first portion and further including a portion overlying said second portion;

(d) an emitter layer comprising a third, electrically conductive layer overlying said first insulator, said third, electrically conductive layer including a portion extending substantially parallel to said second portion and defining an exposed upper edge extending beyond said upper surface for emitting electrons therefrom, said emitter layer being suitable for use as an emitter;

(e) a second insulator comprising a fourth, electrically insulating layer overlying said emitter layer; and (f) a second extraction gate comprising a fifth, conductive layer overlying said second insulator and including a portion extending substantially parallel to said second portion and including an exposed upper edge extending beyond said upper surface, said second extraction gate being suitable for use as an extraction gate.

* * * * *